United States Patent [19]

Boyd

[11] 4,365,766

[45] Dec. 28, 1982

[54] BOBBIN LOCKING DEVICE

[75] Inventor: Jerry R. Boyd, Washington, N.C.

[73] Assignee: Washington Instrument, Inc., Washington, N.C.

[21] Appl. No.: 174,879

[22] Filed: Aug. 4, 1980

[51] Int. Cl.[3] ..... B65H 54/54

[52] U.S. Cl. ..... 242/46.2; 57/130; 242/46.21; 242/46.4

[58] Field of Search ..... 242/46.2, 46.21, 46.3, 242/46.4, 46.5, 46.6, 129.5, 129.7, 129.71, 130, 130.1, 130.2, 68, 68.1, 68.2, 68.3; 57/129, 130

[56] References Cited

U.S. PATENT DOCUMENTS

| | | | |
|---|---|---|---|
| 92,859 | 7/1869 | Mayor | 242/46.2 X |
| 945,188 | 1/1910 | Nichols | 242/130.2 |
| 1,306,256 | 6/1919 | Holt et al. | 242/130.1 |
| 1,661,066 | 2/1928 | De Wolf | 242/130.1 |
| 2,417,525 | 3/1947 | Smith | 57/130 |
| 2,554,148 | 5/1951 | Kenneford | 242/130.2 |
| 2,556,684 | 6/1951 | De Santis | 242/130.2 |
| 2,639,576 | 5/1953 | Bay | 57/130 |
| 2,773,346 | 12/1956 | Childs et al. | 57/130 |
| 2,914,271 | 11/1959 | Staufert | 242/130.2 |
| 2,922,274 | 1/1960 | Sacchini | 57/130 |
| 2,931,593 | 4/1960 | Pray | 242/130.2 |
| 3,197,156 | 7/1965 | Warnock | 242/130.2 |
| 3,246,856 | 4/1966 | Winslow | 242/46.21 |
| 3,367,098 | 2/1968 | Schulz | 242/130.2 X |
| 3,687,382 | 8/1972 | Matsui et al. | 242/130.2 X |

FOREIGN PATENT DOCUMENTS

| | | | |
|---|---|---|---|
| 700750 | 12/1953 | United Kingdom | 242/46.3 |
| 882877 | 11/1961 | United Kingdom | 242/46.4 |
| 1100274 | 1/1968 | United Kingdom | 242/46.4 |

*Primary Examiner*—Stanley N. Gilreath

*Attorney, Agent, or Firm*—Watts, Hoffmann, Fisher & Heinke Co.

[57] ABSTRACT

A new locking arrangement is disclosed for effectively locking bobbins in place on associated roving machine spindles. The locking arrangement includes a body that is drivingly connected to the spindle and has torque transmitting surfaces coacting with the bobbin. A deformable retainer is moveably coupled to the body. An over center cam is moveably coupled to the body and is coactable with the retainer in retainer compression and a retainer release position. When the cam is in the compression position, the retainer is deformed into a lock producing position securing the body and the bobbin in a torque transmitting relationship with forces which include an axial vector urging the members together. When the cam is in a release position, the bobbin can be removed from the spindle.

20 Claims, 4 Drawing Figures

BOBBIN LOCKING DEVICE

DESCRIPTION

1. Technical Field

This invention relates to roving frames and more particularly to a novel and improved mechanism for fixing a thread winding bobbin in driven engagement with a driving spindle.

2. Background Art

In the textile industry threads are manufactured in machines known as roving frames. As a thread is manufactured it is wound on a bobbin. With a typical roving frame a bank of bobbins are concurrently spun at speeds in the order of 1,200–1,400 revolutions per minute as newly formed thread is wound on each. Each bobbin is removably mounted on a drive spindle and each has a coacting flier which functions to distribute the thread evenly on the bobbin as thread is wound on the bobbin.

One type of roving machine which is now widely used, incorporates a bank of vertically extending drive spindles each of which has a driving spur at its top. When the machine is in use, each spindle carries a bobbin, hopefully in driven relationship. The driving spur and bobbin have coacting torque transmitting surfaces. An annular groove is formed in the spur surfaces and an O-ring is mounted in this groove. The O-ring is intended to frictionally engage the coacting surfaces of the bobbin to assist in maintaining the bobbin on the spindle.

Each bobbin has a frusto conical shaped surface near its top which coaxially communicates with a spindle and drive spur receiving bore formed in the bobbin. The driving spur has a plurality of machined slots each of which carries a ball. As the spindle commences to rotate, it is intended that centrifugal force will drive these balls radially outwardly into engagement with the frusto conical surface of the bobbin and provide a bobbin retaining lock.

In practice, the described bobbin retaining mechanism has too often failed to achieve its bobbin retaining function. As a consequence, the bobbin may be thrown from the spindle causing damage to fliers, spindles, bobbins, and other roving frame components. If the bobbin is not being driven properly, it is necessary for the operator to stop the entire machine and in some instances remove the bobbin entirely shutting down the production of one of the thread roving components of the machine. Alternately, if the spindle or bobbin is worn to the point that they will not function properly but only to a point where they still can be caused to function, the operator will laborously make a paper shim which is inserted between the bobbin and spindle for the purpose of providing enough friction between them to hold the bobbin on the spindle in an adequately driven relationship.

It will be apparent that the deficiencies of the described bobbin retaining arrangement are such that it is common for a number of spindles of bank to be nonfunctioning reducing the productivity of the machine. It is also all to common that the machine must be shut down while the operator makes a "fix" to cause as many spindles as possible to appropriately and properly drive associated bobbins.

DISCLOSURE OF INVENTION

According to the present invention, a novel and improved locking arrangement has been conceived which can be retrofit in place of the previously described bobbin drive spur to effectively lock bobbins in place on their associated spindles. Indeed, this new locking arrangement is so effective that badly worn spindles, which would be well beyond their normal productivity with the prior bobbin drive spurs arrangements, continue to function for their intended and desired thread winding procedures.

The bobbin lock of this invention improves the efficiency and profitability of a roving operation by virtually eliminating damage due to bobbins coming off spindles, insuring virtually all spindles are indeed used for thread winding, significantly reducing downtime due to malfunctioning bobbin locking arrangements and significantly reducing the frequency with which spindles must be replaced.

A lock made in accordance with this invention has a body with a through stepped bore. A lower portion of the bore telescopes over the spindle and the body is pin connected to it. A central reduced diameter bore portion communicates with the lower portion and the two are connected by a radially extending clamping shoulder. A headed cam stem projects through central bore and extends upwardly past the top of the body. The head of the stem coacts with the clamping shoulder.

An overcenter cam is rotatably connected to the stem near its top to act against a cam disc which in turn acts against an elastomeric retainer. A spring is carried in a large upper bore portion urging the retainer upwardly and with it the cam and stem so that the head is maintained in engagement with the clamping shoulder.

When the cam is in a release position a spindle may be telescoped over the lock device and down over the spindle until complemental surfaces on the bobbin and the lock body are in engagement for the transmission of bobbin rotation torque. The cam is then moved to a locked position to distend the retainer into bobbin retaining lock engagement with the frusto conical shaped surface designed for engagement with the radially movable centrifugal balls of the prior art. With the retainer so deformed the bobbin is firmly locked on the spindle and will not accidently be removed.

While the bobbin is firmly locked on the spindle, it is nonetheless facilely removable by manual action. When a bobbin is manually raised against the action of the elastomeric retainer, the retainer is sufficiently deformable to permit the bobbin to be moved axially into engagement with a cam tab. Thereafter the bobbin is moved upwardly against the tab until the cam passes over center and the entire locking arrangement is released. Alternately the cam can easily be moved to its release position when an operator simply rotates it about the pivotal connection of the cam stem.

Thus, the locking device of this invention is a positive action device with finger trip control which will not increase either stopping or startup times compared with the prior art. In addition if a spindle falls unlike the prior art, the bobbin is automatically released from the spindle and no damage results. The device has no screws to be released and no adjustments are necessary. In addition to all of these advantages tests have shown that the device will drive a bobbin with the order of 50-80% of the bobbin drive surfaces being worn away and yet there is no noticeable slippage.

Accordingly, an object of this invention is to provide a novel and improved locking device for assuring driving relationship between a spindle and a bobbin.

BEST MODE FOR CARRYING OUT THE INVENTION

Figure 1:
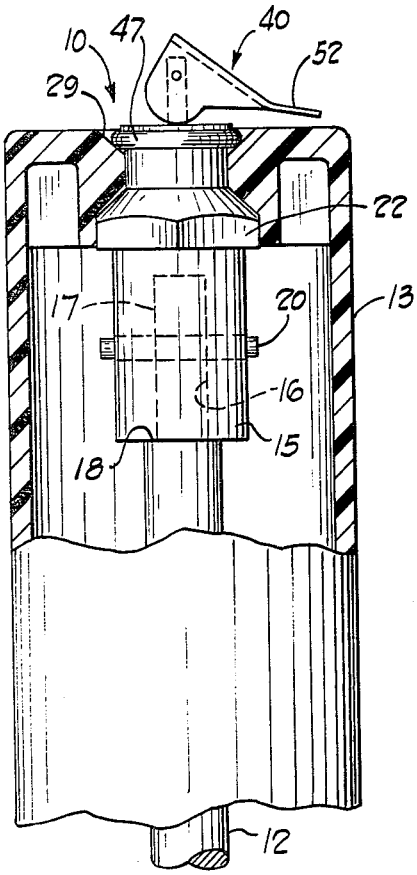
FIG. 1 is a fragmentary sectional view showing a top portion of a bobbin in cross section, a top portion of a spindle and the locking mechanism of this invention interposed between the spindle and the bobbin.

Referring to the drawings, a bobbin lock assembly made in accordance with this invention is shown generally at 10. The lock assembly 10 is mounted on a spindle 12 for rotation with it. A thread winding bobbin 13 telescopes over the assembly 10 and the spindle 12 and is retained in place on the spindle when the lock is in the position shown in FIGS. 1 and 3.

The lock assembly 10 includes a tubular lock body 15. The body 15 has a through bore including a lower spindle receiving portion 16. The body telescopes over a reduced diameter spindle top portion 17 and seats against the spindle shoulder 18, FIG. 1. A pin 20 extends radially through aligned transverse bores in the spindle and the body 12, 15 to fix the two together and maintain the lock assembly 10 fixedly connected to the spindle 12.

The body 15 includes external hexagonal torque transmitting surfaces 22 which engage complemental surfaces 23 formed in the bobbin to provide torque transmission between the spindle and the bobbin when the spindle is rotated. The body has a frusto conical bobbin support surface 24 which engages a complemental bobbin surface 25 to provide vertical support for the bobbin. Radial location of the bobbin on the lock is provided by coacting cylindrical surfaces 26, 28 formed on the body and in bobbin respectively.

A frusto conical outwardly flaring lock surface 29 is formed near the top of the bobbin in coaxial alignment with the cylindrical surface 28 and the bobbin complemental supporting surface 25.

The body 15 has a central bore portion 30 which is axially aligned with and in communication with the spindle receiving bore portion 16. A radially extending annular clamping shoulder 32 interconnects the spindle and central bore portions 16, 30. A cam stem mechanism is provided which includes a stem 34 and head 35. The head 35 abuts the shoulder 32 while the stem 34 extends axially upwardly through the central bore portion 30 and an axially aligned upper spring receiving bore portion 36. An annular radially extending spring engaging shoulder 37 connects the central and the spring bore portions 30, 36.

Figure 2:
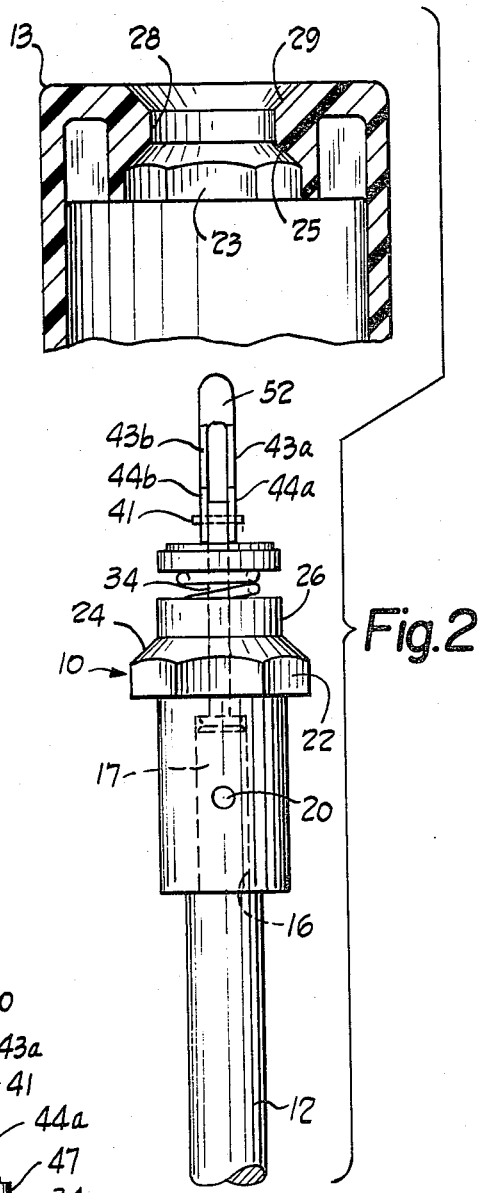
FIG. 2 is an exploded view showing the lock mechanism in its release position and the relative spatial relationship of a bobbin and spindle as the bobbin is about to be placed on, or is being removed from, the spindle.

An overcenter actuator cam 40 is rotatably mounted on the stem 34 by a cam pin 41. Cam 40 includes a central strut section 42 and a pair of spaced and parallel cam lobe sections **43*a*, 43*b*. The cam lobe sections 43*a*, 43*b* are perpendicular to the strut section 42 projecting from edge portions of it. As can best be seen in FIG. 2 the cam pin 41 extends through both of the cam lobe sections 43*a*, 43*b* to secure the cam in its rotational engagement with the cam stem 34**.

The cam has a pair of essentially semi-circular camming lobes **44*a*, 44*b*. These lobes act against a camming disk 46 which is a substantially flat annulus that is mounted around the cam stem 34. A deformable elastomeric retainer 47 is around the cam stem 34. The retainer is interposed between camming disk 46 and an annular radially extending top surface 48 of body 15**.

Figure 3:
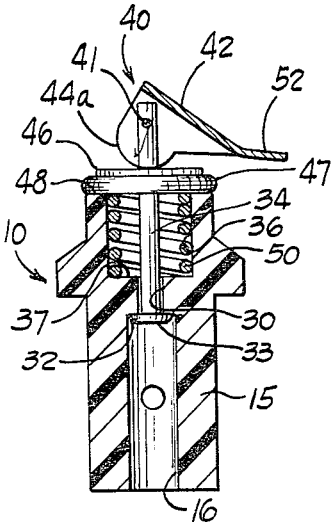
FIG. 3 is a cross-sectional view of the lock mechanism of this invention in its locked position; and, FIG. 4 is a cross-sectional view of the lock mechanism of this invention showing the cam in its release position.

A retainer release coil spring 50 is disposed in the spring bore portion 36 and interposed between the retainer 46 and the spring shoulder 37. When the cam is in its locked position as shown in FIGS. 1 and 3 the retainer is compressed against the top surface 48 and deformed into bobbin locking engagement as is shown in FIG. 1. When the cam is in this locked position the spring 50 is compressed into an ineffectual position.

Figure 4:
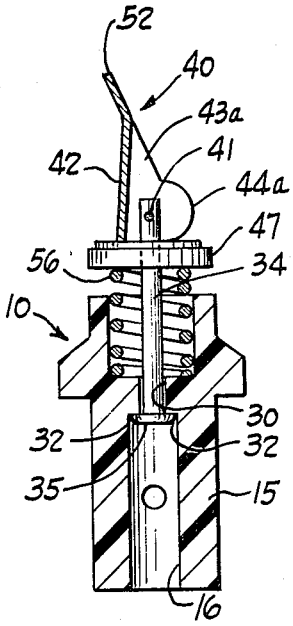

The cam 40 includes an actuating tab 52 which may be grasped manually and rotated counterclockwise from the position of FIGS. 1 and 3 to the position of FIG. 4 which is the cam release position. When the cam is in the release position in FIG. 4 the coil spring 50 elevates the now relaxed and substantially undeformed retainer 47 against the disk 46. The disk in turn acts against the cam and thus elevates the cam stem 34 maintaining the head 35 in engagement with the clamping shoulder 32.

Should a spindle have a failure known in the textile industry as a "fall" the bobbin will act against the tab 52 thereby shifting the cam to its release position 54 so that no further damage will result.

While a preferred embodiment of the invention has been disclosed in detail, various modifications or alterations may be made herein without departing from the spirit and scope of the invention set forth in the appended claims.

I claim:

1. In a roving machine of the type including a plurality of bobbins which are rotatable at relatively high speeds to wind thread thereon, the improved bobbin drive comprising:

(a) a spindle member;

(b) a bobbin member; and (c) a member interconnecting assembly comprising:

(i) a body drivingly connected to one of the members and having torque transmitting surfaces located relative to and coactable with complemental surfaces on the other of the members to transfer torque transmitting forces between the body and the other member;

(ii) a deformable retainer movably coupled to said body;

(iii) an overcenter cam movably coupled to said body and being coactable with the retainer and having retainer compression and retainer release positions; and, (iv) the retainer when the cam is in its compression position being deformed into a lock producing position securing the body and the other member in torque transmitting relationship, with a force which includes an axial vector urging the members together, when the cam is in its release position being in an uncompressed condition to permit removal of the bobbin from the spindle.

2. The improvement of claim 1 wherein the spindle is the one member.

3. The bobbin device of claim 1 wherein the bobbin member has a pair of ends, one around the spindle member when the members are connected and wherein the retainer acts against a bobbin member surface near its other end.

4. A lock for securing a winding bobbin on a spindle comprising:

(a) a tubular body having a through, shouldered bore and external force transmitting surfaces;

(b) a cam stem mechanism including a head engageable with a first body shoulder and a stem extending from the first shoulder through a portion of the bore to a location external of the body;

(c) a cam rotatably mounted on the stem for movement between lock and release positions;

(d) an annular elastomeric retainer surrounding the stem and interposed between the cam and the body, the retainer being deformable to a bobbin lock position when the cam is in its lock position and returnable to a bobbin release position when the cam is in its release position;

(e) an annular caming disc around the stem and between the cam and the retainer to apply cam produced retainer deforming forces to the retainer when the cam is in its lock position; and, (f) a retainer release spring around the stem and interposed between the retainer and another body shoulder and applying a biasing force against the retainer in a direction toward the cam.

5. A lock for securing a winding bobbin on a spindle comprising:

(a) a tubular body having a through, shouldered bore including a relatively small diameter central bore portion, and an enlarged end bore portion and a pair of radially disposed shoulders respectively interconnecting the enlarged portions and the central portion, the body also having external force transmitting surfaces;

(b) a cam stem mechanism including a head engageable with one of the shoulders and a stem extending from the one shoulder through the central portion of the bore and through one of the enlarged portions to a location external of the body;

(c) a cam rotatably mounted on the stem for movement between lock and release positions;

(d) an annular elastomeric retainer surrounding the stem and interposed between the cam and the body and being deformable to a bobbin lock position when the cam is in its lock position and returnable to a bobbin release position when the cam is in its release position;

(e) an annular caming disc around the stem and between the cam and the retainer to apply cam produced retainer deforming forces to the retainer when the cam is in its lock position; and, (f) a retainer release spring around the stem, interposed between the retainer and the other body shoulder and within said one enlarged portion, the spring applying a biasing force against the retainer in a direction toward the cam.

6. In a thread winding machine a mechanism for maintaining bobbin and spindle structures in predetermined spacial relationships comprising:

(a) an elastomeric retainer member movably coupled to one of said structures and compressed when in use into structure position retaining engagement with a force having an axial component against a lock surface on said bobbin structure urging the structures together;

(b) a cam movably connected to one of the structures and operably engageable with the retainer when in a lock position to deform the retainer and force the retainer into its structure position retaining engagement against said lock surface; and, (c) the cam being movable to a retainer release position to release retainer deformation pressure and permit removal of the bobbin from the spindle.

7. A winding spindle and bobbin assembly comprising:

(a) a rotatable spindle;

(b) a bobbin having a lock surface received on the spindle; and (c) a bobbin lock partly surrounded by the bobbin and including:

(i) a central body portion;

(ii) a cam movably connected to the central body portion;

(iii) an elastomeric retainer disposed between the cam and the central body portion;

(d) movement of the cam being adapted to apply compressive forces to press the retainer into contact with said lock surface of said bobbin to retain said bobbin on the spindle, the force including an axial component applied to the bobbin in a bobbin on direction; and, (e) the cam being movable to a position wherein the applied compressive forces are reduced thereby reducing contact with said lock surface to permit facile removal of the bobbin from the spindle.

8. The assembly of claim 7, wherein the bobbin lock has a torque transmitting surface engaging a cooperating surface of the bobbin whereby torque is transferred between the bobbin and the spindle.

9. The assembly of claim 7 further including a coil spring applying a biasing force against the retainer in a direction away from the body portion.

10. The bobbin device of claim 7 wherein the bobbin has a pair of ends, one around the spindle when the spindle and bobbin are connected and wherein the bobbin lock surface is near the other end of the bobbin.

11. A bobbin locking mechanism for use in thread winding machines, said mechanism comprising:

a spindle structure having a bobbin support surface for supporting a bobbin;

an elastomeric retainer movably coupled to said spindle structure; and actuator means for compressing said elastomeric retainer against said spindle structure causing said elastomeric retainer to exert an axial locking force toward said support surface and against a positioned bobbin.

12. The mechanism of claim 11 wherein said actuator means is a cam pivotaly coupled to said spindle structure.

13. The mechanism of claim 12 wherein the cam includes a tab portion for moving the cam to compress said retainer.

14. The mechanism of claim 13 wherein said tab is in proximity to said bobbin when said cam is in a retainer compression position and wherein the bobbin may be manually disconnected from the spindle structure by axially moving the bobbin away from said support surface into contact with said tab and causing the cam to move from its retainer compression position.

15. The mechanism of claim 11 wherein said spindle structure comprises a spindle and a body fixed to the end of the spindle.

16. The mechanism of claim 11 wherein said support surface comprises torque driving surfaces coactable with compatable surfaces of said bobbin for position locating and driving of said bobbin by said spindle structure.

17. In a roving machine of the type including a plurality of bobbins which are rotatably at relatively high speeds to wind thread thereon, the improved bobbin drive comprising:

(a) a spindle member
(b) a bobbin member; and
(c) a member interconnecting assembly comprising:
(i) a body drivingly connected to one of the members and having torque transmitting surfaces located relative to and coactable with complemental surfaces on the other of the members to transfer torque transmitting forces between the body and the other member;
(ii) a deformable retainer connected to a selected one of the members and the body;
(iii) an overcenter cam coactably coupleable with the retainer and having retainer compression and retainer release positions; and,
(iv) the retainer when the cam is in its compression position being deformed into a lock producing position securing said selected one and another of the body and members in torque transmitting relationship with a force which includes an axial vector urging the members together, when the cam is in its release position being in an uncompressed condition to permit removal of the bobbin member from the spindle member.

18. In a roving machine of the type including a plurality of bobbins which are rotatable at relatively high speeds to wind thread thereon, the improved bobbin drive comprising:

(a) a spindle member;
(b) a bobbin member; and
(c) a member interconnecting assembly comprising:
(i) a body drivingly connected to one of the members and having torque transmitting surfaces located relative to and coactable with complemental surfaces on the other of the members to transfer torque transmitting forces between the body and the other member;
(ii) a deformable retainer movably coupled to said body;
(iii) an overcenter cam movably coupled to said body and being coactable with the retainer and having retainer compression and retainer release positions; and,
(iv) the retainer when the cam is in its compression position being deformed into a lock producing position securing the body and the other member in torque transmitting relationship and when the cam is in its release position being in an uncompressed condition to permit removal of the bobbin from the spindle;
(d) the cam including a tab portion for moving the cam from one of its positions to the other, said tab being in proximity to said bobbin member when said cam is in the retainer compression position; and,
(e) the bobbin member being manually disconnectable from the spindle member by axially moving it into engagement with the tab portion and causing the cam to move from its retainer compression to its retainer release position.

19. A lock for securing a winding bobbin on a spindle comprising:

(a) a tubular body having a through, shouldered bore and external force transmitting surfaces;
(b) a cam stem mechanism including a head engageable with a first body shoulder and a stem extending from the first shoulder through a portion of the bore to a location external of the body;
(c) a cam rotatably mounted on the stem for movement between lock and release positions;
(d) an elastomeric retainer interposed between the cam and the body, the retainer being deformable to a bobbin lock position when the cam is in its lock position and returnable to a bobbin release position when the cam is in its release position;
(e) a caming disc between the cam and the retainer to apply cam produced retainer deforming forces to the retainer when the cam is in its lock position; and,
(f) a retainer release spring interposed between the retainer and another body shoulder and applying a biasing force against the retainer in a direction toward the cam.

20. The bobbin device of claim 17 wherein the bobbin member has a pair of ends, one around the spindle member when the members are connected and wherein the retainer acts against a bobbin member surface near its other end.

* * * * *